US010222006B2

(12) United States Patent
Vashi et al.

(10) Patent No.: US 10,222,006 B2
(45) Date of Patent: Mar. 5, 2019

(54) TUBULAR LAMP AND LAMP SOCKET WITH POWER PIN CONNECTOR AND SIGNAL PIN CONNECTOR

(71) Applicant: Energy Focus, Inc., Solon, OH (US)

(72) Inventors: Bhaumik Mukeshbhai Vashi, Mayfield Heights, OH (US); Jeremiah A. Heilman, Rochester, MN (US)

(73) Assignee: ENERGY FOCUS, INC., Solon, OH (US)

( * ) Notice: Subject to any disclaimer, the term of this patent is extended or adjusted under 35 U.S.C. 154(b) by 41 days.

(21) Appl. No.: 15/458,497

(22) Filed: Mar. 14, 2017

(65) Prior Publication Data

US 2017/0268731 A1 Sep. 21, 2017

Related U.S. Application Data

(60) Provisional application No. 62/308,391, filed on Mar. 15, 2016.

(51) Int. Cl.
*F21K 9/278* (2016.01)
*F21V 23/00* (2015.01)
(Continued)

(52) U.S. Cl.
CPC ..... *F21K 9/278* (2016.08); *F21V 23/003* (2013.01); *H01R 13/64* (2013.01);
(Continued)

(58) Field of Classification Search
CPC . F21V 23/06; F21K 9/27; F21K 9/272; F21K 9/278; H01R 13/04; H01R 13/26; H01R 13/64; H01R 13/642
See application file for complete search history.

(56) References Cited

U.S. PATENT DOCUMENTS 5,625,258 A 4/1997 Preis
9,497,821 B2 11/2016 Liu
(Continued)

FOREIGN PATENT DOCUMENTS

CN 106163029 A 11/2016
CN 106714395 A 5/2017
(Continued)

OTHER PUBLICATIONS

PCT Notification of Transmittal of the International Search Report and the Written Opinion of the International Searching Authority, or the Declaration; International Search Report; Written Opinion of the International Search Authority, dated May 23, 2017, 15 pages.
(Continued)

*Primary Examiner* — Anh T Mai
*Assistant Examiner* — Steven Y Horikoshi
(74) *Attorney, Agent, or Firm* — Rankin, Hill & Clark LLP

(57) ABSTRACT

A tubular light emitting diode lamp includes a lamp body, a plurality of light emitting diodes disposed on the lamp body, and a first lamp base and a second lamp base that are disposed at opposite ends of the lamp body. At least one of the first lamp base and the second lamp base includes at least one primary pin and at least one secondary pin. The tubular light emitting diode lamp also includes a driver electrically connected to the plurality of light emitting diodes, the at least one primary pin, and the at least one secondary pin. The least one primary pin provides power to the driver to cause the plurality of light emitting diodes to emit light and the at least one secondary pin provides a signal to the driver that is distinct from the power.

20 Claims, 4 Drawing Sheets

(51) Int. Cl.

| | |
|---|---|
| ***H01R 13/64*** | (2006.01) |
| ***H01R 33/74*** | (2006.01) |
| ***H05B 33/08*** | (2006.01) |
| ***H05B 37/02*** | (2006.01) |
| ***H01R 33/08*** | (2006.01) |
| *F21Y 103/10* | (2016.01) |
| *F21Y 115/10* | (2016.01) |

(52) U.S. Cl.
CPC ..... *H01R 33/0836* (2013.01); *H01R 33/74* (2013.01); *H05B 33/0845* (2013.01); *H05B 37/0209* (2013.01); *F21Y 2103/10* (2016.08); *F21Y 2115/10* (2016.08)

(56) References Cited

U.S. PATENT DOCUMENTS

| | | | | |
|---|---|---|---|---|
| 9,521,718 | B2 | 12/2016 | Xiong et al. | |
| 9,526,145 | B2 | 12/2016 | Xiong et al. | |
| 9,585,221 | B1 | 2/2017 | Chen et al. | |
| 9,587,817 | B2 | 3/2017 | Liu et al. | |
| 2008/0151535 | A1 | 6/2008 | de Castris | |
| 2010/0117558 | A1 | 5/2010 | Lee | |
| 2011/0149563 | A1* | 6/2011 | Hsia | F21V 25/04 362/221 |
| 2012/0176714 | A1 | 7/2012 | Cheng | |
| 2012/0299494 | A1 | 11/2012 | Hartikka | |
| 2012/0307524 | A1* | 12/2012 | Schapira | H01R 13/7175 362/652 |
| 2013/0113393 | A1 | 5/2013 | Fujita et al. | |
| 2014/0015345 | A1 | 1/2014 | Ivey et al. | |
| 2015/0062889 | A1 | 3/2015 | Kika | |
| 2015/0163867 | A1 | 6/2015 | Recker et al. | |
| 2016/0091149 | A1* | 3/2016 | Glachman | F21V 15/015 362/223 |
| 2016/0348851 | A1 | 12/2016 | Amrine, Jr. et al. | |
| 2017/0310157 | A1 | 10/2017 | Cannon et al. | |

FOREIGN PATENT DOCUMENTS

| | | | |
|---|---|---|---|
| DE | 4342590 | A1 | 6/1995 |
| GB | 2488845 | | 9/2012 |
| GB | 2489513 | | 10/2012 |
| WO | 2010/127366 | A2 | 11/2010 |
| WO | 2016/154845 | A1 | 10/2016 |

OTHER PUBLICATIONS http://www.cornledbulb.com/sale-4194460-battery-backup-t8-emergency-led-tube.html; "Battery Backup T8 Emergency LED Tube"; Brand name: Romanso, Copyright 2015-2016 comledbulb.com; 4 pages.

http://www.cfhtel.com; "Quotation of Wall Switch Control T8 LED Emergency Tube", Shenzhen Chengfenghao Electronics Co., LTD., Jul. 13, 2016, 3 pages.

http://www.cfhtel.com; Quotation of T8 LED Emergency Tube with Remote Control:, Shenzhen Chengfenghao Electronics Co., LTD., Jul. 13, 2016, 3 pages.

http://www.itsuwaled.com/pd.jsp?id=6.com; Product Detail of "Emergency + Sensor T8 LED Tube"; Model YSH-T8XX-Y01-XX; Shenzhen Itsuwa Light Co., Ltd., Shenzhen, China, 12 pages.

International Search Report/Written Opinion, PCT/US2017/028711, dated Jul. 11, 2017, 15 pages.

International Search Report and Written Opinion, PCT/US2017/033075, dated Mar. 19, 2018, 16 pages.

U.S. Office Action, U.S. Appl. No. 15/493,216, dated Jun. 29, 2018, 52 pages.

U.S. Appl. No. 15/497,127, filed Apr. 25, 2017, 21 pages.

* cited by examiner

TUBULAR LAMP AND LAMP SOCKET WITH POWER PIN CONNECTOR AND SIGNAL PIN CONNECTOR

BACKGROUND

Tubular light emitting diode (TLED) lamps are a recent development in the lighting industry, and can be used as replacements for fluorescent (FL) lamps. Accordingly, TLED lamps typically have a similar construction (i.e., size and shape) to FL lamps. For example, TLEDs may be generally long tubes (e.g., 2', 4', etc.) with an outer diameter of less than 2". Further, the TLEDs include bases that are disposed at opposite longitudinal ends of the tube.

These bases can be of any number of configurations, including for example, G13 medium bi-pin connectors or connections. Further, the same or similar connectors can be used on both FL lamps and TLED lamps. However, the TLED lamps can have different operating requirements than FL lamps. For example, some TLEDs run on AC power, while others run on low voltage DC power. Additionally, some TLEDs integrate driver electronics, while others have the driver electronics located outside of or external to the TLED lamp.

As a result of the connectors being unchanged from FL lamps to TLED lamps, a TLED lamp can be physically installed in a fixture with FL sockets. While physically interchangeable, the TLED lamp may not be electrically compatible with the FL fixture, thereby providing the opportunity for a variety of operating issues.

BRIEF DESCRIPTION

According to an aspect of the present disclosure, a tubular light emitting diode lamp includes a lamp body, a plurality of light emitting diodes disposed on the lamp body, and a first lamp base and a second lamp base that are disposed at opposite ends of the lamp body. At least one of the first lamp base and the second lamp base includes at least one primary pin and at least one secondary pin. The tubular light emitting diode lamp also includes a driver electrically connected to the plurality of light emitting diodes, the at least one primary pin, and the at least one secondary pin. The least one primary pin provides power to the driver to cause the plurality of light emitting diodes to emit light and the at least one secondary pin provides a signal to the driver that is distinct from the power.

According to another aspect, a lighting assembly includes a tubular light emitting diode lamp. The lamp includes a lamp body, a plurality of light emitting diodes disposed on the lamp body, and a first lamp base and a second lamp base that are disposed at opposite ends of the lamp body. At least one of the first lamp base and the second lamp base includes at least one primary pin and at least one secondary pin. The tubular light emitting diode lamp also includes a driver electrically connected to the plurality of light emitting diodes, the at least one primary pin, and the at least one secondary pin. The least one primary pin provides power to the driver to cause the plurality of light emitting diodes to emit light and the at least one secondary pin provides a signal to the driver that is distinct from the power. The lighting assembly also includes a first lamp socket and a second lamp socket that are spaced from one another so as to receive the first lamp base and the second lamp base, respectively. At least one of the first lamp socket and the second lamp socket includes at least one power contact configured for electrical connection with the at least one primary pin and at least one signal contact configured for electrical connection with the at least one secondary pin.

DETAILED DESCRIPTION

Figure 1:
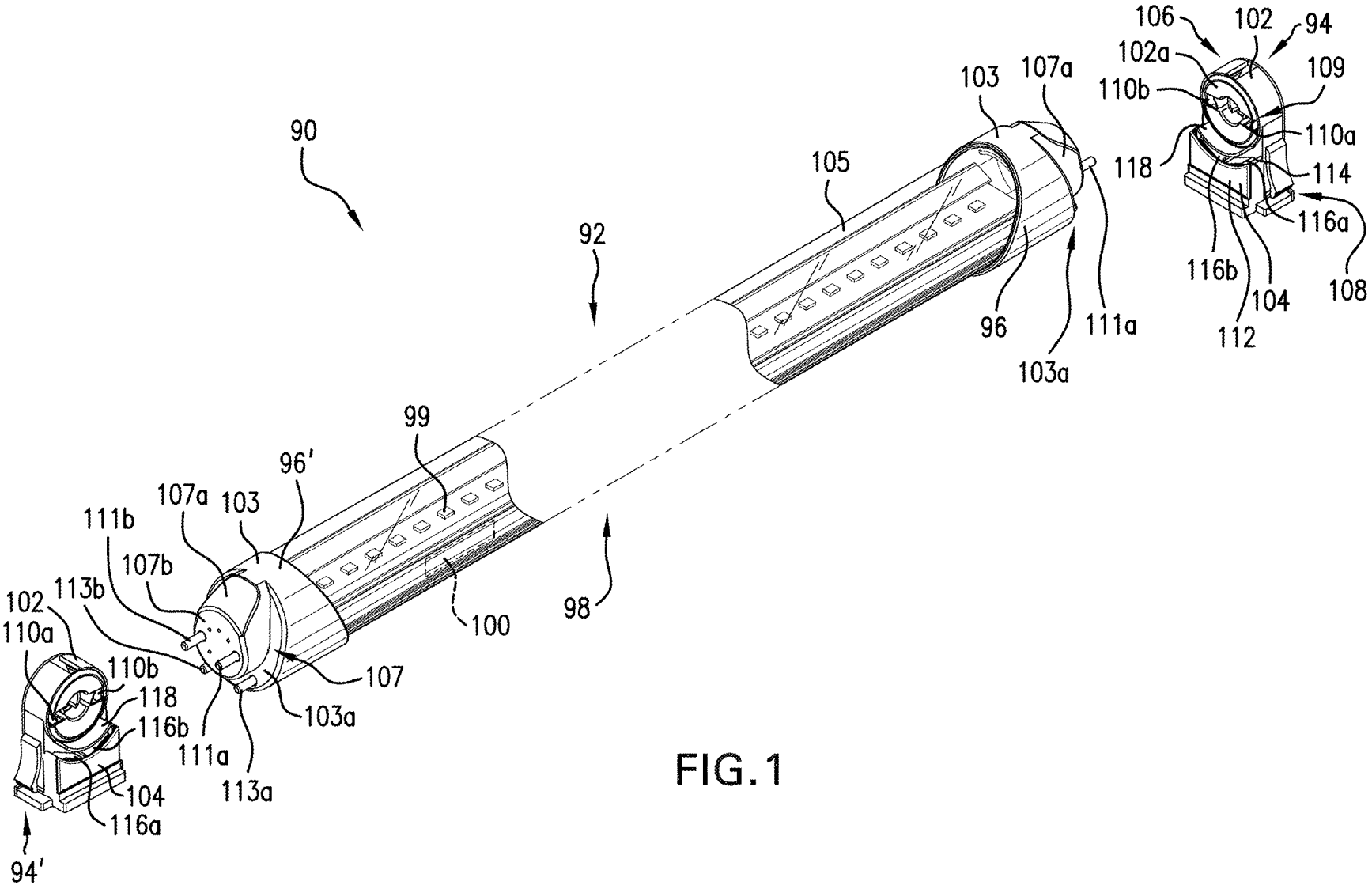
FIG. 1 is a perspective view of an exemplary lamp and a pair of lamp sockets in an uninstalled state, according to one or more embodiments.

FIG. 1 illustrates a lighting assembly 90. The assembly 90 includes a TLED lamp 92 and may also include a first lamp socket 94 and a second lamp socket 94'. The lamp sockets 94, 94' may be identical in construction and spaced from one another for receipt of a first lamp base 96 and a second lamp base 96' of the lamp 92.

The lamp 92 can include a lamp body 98 that extends between the bases 96, 96' in a tubular manner and houses a plurality of light emitting diodes 99 and a driver 100. Notably, the light emitting diodes 99 provide sufficient lumen output to be acceptable for general illumination. The lamp body 98 may be of polymer construction and cooperate with a lens 105 to define an interior chamber for receiving the light emitting diodes 99 and the driver 100. As will be appreciated, the lens 105 is of a material that allows for the transmission of light therethrough, whereas the lamp body 98 may be of a material that does not allow for the transmission of light therethrough.

The bases 96, 96' of the lamp 92 are identical in construction, unless otherwise noted. For simplicity, the following description will be directed to the first base 96, but it will be understood to be equally applicable to the second base 96'. The base 96 includes a perimeter wall 103 that at least partially surrounds the lamp 92 in a circumferential manner. From an end view, the base 96 has a generally circular shape and includes a base face 103*a* that is generally orthogonal to the perimeter wall 103.

A protrusion 107 extends from the base face 103*a* in a direction away from the lamp body 98. The protrusion 107 includes at least one side wall 107*a* and a protrusion face 107*b*. The protrusion face 107*b* is outwardly spaced from the base face 103*a*. The protrusion 107 may be integral or separate from the base 96 without departing from the scope of the disclosure.

A pair of primary pins 111*a*, 111*b* extend from the protrusion face 107*b* in a direction away from the lamp body 98. Although the following discussion refers to the primary pins 111*a*, 111*b* as being a pair of pins, it will be appreciated that there could merely be at least one primary pin without departing from the scope of the disclosure. The primary pins 111*a*, 111*b* are made of an electrically conductive material and have a cylindrical shape. The primary pins 111*a*, 111*b* are spaced from one another according to industry standards, and are for the introduction of electricity into the lamp 92. Notably, the primary pins 111*a*, 111*b* may be the size and position so as to be physically interchangeable with other lamps that have a G13 base.

As illustrated, the lamp 92 can include another pair of pins 111*a*, 111*b* of the second base 96' at the opposite end of the lamp 92. Further, a distance between the primary pins 111*a*, 111*b* of the base 96 and the pins 111*a*, 111*b* of the base 96' would comply with all standards for dimensional requirements for linear lamps. Further still, the primary pins 111*a*, 111*b* of the first base 96 are aligned with the primary pins 111*a*, 111*b* of second base 96' such that a respective primary pin 111*a* of the first base 96 shares a common axis with a respective primary pin 111*a* of the second base 96' and a respective primary pin 111*b* of the first base 96 shares a common axis with a respective primary pin 111*b* of the second base 96'.

Stated another way, from the free end of the primary pins 111*a*, 111*b* of the base 96 to the free end of the primary pins 111*a*, 111*b* of the base 96' defines a maximum overall length of the lamp 92. The maximum overall length of the lamp 92 is according to industry standard and allows for installation of the lamp 92 in traditional lamp sockets which may differ in appearance and layout from the lamp sockets 94, 94' described herein. The primary pins 111*a*, 111*b* of the base 96' may or may not allow for the introduction of electricity into the lamp 92.

The base 96 of the lamp 92 can also include secondary pins 113*a*, 113*b*. Although the following discussion refers to the secondary pins 113*a*, 113*b* as being a pair of pins, it will be appreciated that there could merely be at least one secondary pin without departing from the scope of the disclosure. The secondary pins 113*a*, 113*b* may be made of an electrically conductive material. As illustrated, the secondary pins 113*a*, 113*b* extend from the base face 103*a* of the base 96 in a direction away from the lamp body 98 and such that the secondary pins 113*a*, 113*b* of the base 96 are generally parallel to the primary pins 111*a*, 111*b* of the base 96. The secondary pins 113*a*, 113*b* of the first base 96 are aligned with the secondary pins 113*a*, 113*b* of second base 96' such that a respective secondary pin 113*a* of the first base 96 shares a common axis with a respective secondary pin 113*a* of the second base 96' and a respective secondary pin 113*b* of the first base 96 shares a common axis with a respective secondary pin 113*b* of the second base 96'.

Further, the secondary pins 113*a*, 113*b* of the base 96' are generally parallel to the primary pins 111*a*, 111*b* of the base 96'. Further still, the secondary pin 113*a* is generally parallel to the secondary pin 113*b* and the primary pin 111*a* is generally parallel to the primary pin 111*b*. Finally, the secondary pins 113*a*, 113*b* of the base 96 are generally parallel to the primary pins 111*a*, 111*b* of the base 96' and the primary pins 111*a*, 111*b* of the base 96 are generally parallel to the secondary pins 113*a*, 113*b* of the base 96'.

The secondary pins 113*a*, 113*b* are shown as a pair; however, it will be appreciated that a single pin could be utilized. As shown, the secondary pins 113*a*, 113*b* are cylindrical in shape. This cylindrical shape can allow for easy installation of the bases 96, 96' of the lamp 92 into the lamp sockets 94, 94' during rotation of the lamp 92. Thus, at least one of the first lamp base 96 and the second lamp base 96' includes at least one primary pin 111*a*, 111*b* and at least one secondary pin 113*a*, 113*b*.

Other shapes of the secondary pins 113*a*, 113*b* are possible without departing from the scope of the disclosure. Further, the secondary pins 113*a*, 113*b* extend from the base face 103*a* a distance that is less than a distance between the base face 103*a* and the free end of the primary pins 111*a*, 111*b* of the base 96. Further, the secondary pins 113*a*, 113*b* extend from the base face 103*a* a distance that is less than a distance that the protrusion face 107*b* is spaced from the base face 103*a*.

Further still, a distance between a free end of the primary pins 111*a*, 111*b* on the first lamp base 96 and a free end of the primary pins 111*a*, 111*b* on the second lamp base 96' is greater than a distance between a free end of the secondary pins 113*a*, 113*b* on the first lamp base 96 and a free end of the secondary pins 113*a*, 113*b* on the second lamp base 96'. It is also noted that the secondary pins 113*a*, 113*b* are in electrical communication with the driver 100 within the lamp 92 as will be described in more detail hereinafter.

With attention once again to the lamp socket 94, 94', corners (unnumbered) of the housing portion 102 can be rounded. However, it will be appreciated that the housing portion 102 could be of any number of shapes without departing from the scope of this disclosure. It is envisioned that the housing portion 102 could be made of a variety of materials, including for example, porcelain or composite polymer materials. Further, the housing portion 102 may be an electrical insulator.

The housing portion 102 includes a first end 106 and a second end 108. The first end 106 and the second end 108 are disposed at generally opposite ends of the housing portion 102. Near to the first end 106, the housing portion 102 can including a housing face 102*a* that define at least one blind bore 109. As illustrated, the blind bore 109 is ring-shaped. As will be appreciated, the housing face 102*a* would face the base face 103*a* when the lamp 92 is in the installed state.

Disposed within the blind bore 109 are power contacts 110*a*, 110*b*. The power contacts 110*a*, 110*b* are of an electrically conductive material and provide electrical communication between the TLED lamp 92 and an external power source (not shown). The power contacts 110*a*, 110*b* can be G13 bi-pin sockets or connectors or another type of power contact (e.g., which may be spaced differently, sized differently, etc.).

The power contacts 110*a*, 110*b* are configured to supply mains power to primary pins 111 of the TLED lamp 92 when the lamp 92 is inserted into the lamp socket 94 so as to power the lamp 92. A TLED fixture could include a pair of lamp sockets 94, 94' disposed at longitudinally opposite ends of the fixture. These lamp sockets could be of identical construction of one another. Alternatively, the lamp socket assemblies could be in different configurations from one another. For example, power could be supplied to the TLED lamp 92 through only one of the lamp sockets. As will also be appreciated, the external power source could be any number of voltages, currents, and phases without departing from the scope of the disclosure.

Disposed near the second end 108 of the housing portion 102, is the auxiliary interface portion 104. As illustrated, the auxiliary interface portion 104 extends from the housing portion 102 so as to define an interior direction. It is envisioned that the auxiliary interface portion 104 could be of any number of shapes. For example, the auxiliary interface portion 104 could be rectangular, rounded, elliptical, etc. without departing from the disclosure. Further, the auxiliary interface portion 104 can be made of the same or similar materials as the housing portion 102. The auxiliary interface portion 104 can be integral to the housing portion 102, as illustrated, or can be a separate component. When a pair of lamp sockets 94, 94' are utilized, the auxiliary interface portions 104 of the respective sockets 94, 94' would extend toward one another.

The auxiliary interface portion 104 includes a mounting face 112 and a lamp engagement face 114 that can be generally orthogonal to one another. Further, the lamp engagement face 114 can be generally orthogonal to the housing face 102*a* and the mounting face 112 can be generally parallel to the housing face 102*a*. Generally, the mounting face 112 would face toward the base face 103*a* and the lamp engagement face 114 would face toward the side wall 107*a* of the protrusion 107 when the lamp 92 is in the installed state.

The auxiliary interface portion 104 has one or more signal contacts 116*a*, 116*b* that are electrically conductive for electrical engagement with the secondary pins 113*a*, 113*b*. As shown, the signal contacts 116*a*, 116*b* are disposed on the lamp engagement face 114. As illustrated, the auxiliary interface portion 104 has a curved shape and the signal contacts 116*a*, 116*b* share similar alignment. It will be understood that the shape of these components contributes to easy installation of the lamp 92 into the lamp sockets 94, 94'.

The secondary pins 113*a*, 113*b* each include a perimeter surface face and a free end face. The secondary pins 113*a*, 113*b* extend from the base face 103*a* such that the free end face is generally parallel to the base face 103*a*. Further, a perimeter surface face is adapted to electrically interface with a respective lamp socket 94 such that less than 50% of a surface area of the perimeter surface face directly contacts the signal contacts 116*a*, 116*b* of the lamp socket 94. This limited engagement ensures that the lamp 92 is easily installed into the socket 94 with minimum rotational force required.

Although the figures illustrate the auxiliary interface portion 104 as having two signal contacts 116*a*, 116*b*, additional or fewer signal contacts 116*a*, 116*b* may be utilized. Similarly, additional signal contacts may be provided, such as one or more Ethernet signal contacts (e.g., resulting in four, eight, or any number of signal contacts) without departing from the present disclosure. When the driver 100 is integrated into the TLED lamp 92, control signals may be desired for operation, such as dimming signals or digital communication.

Figure 2:
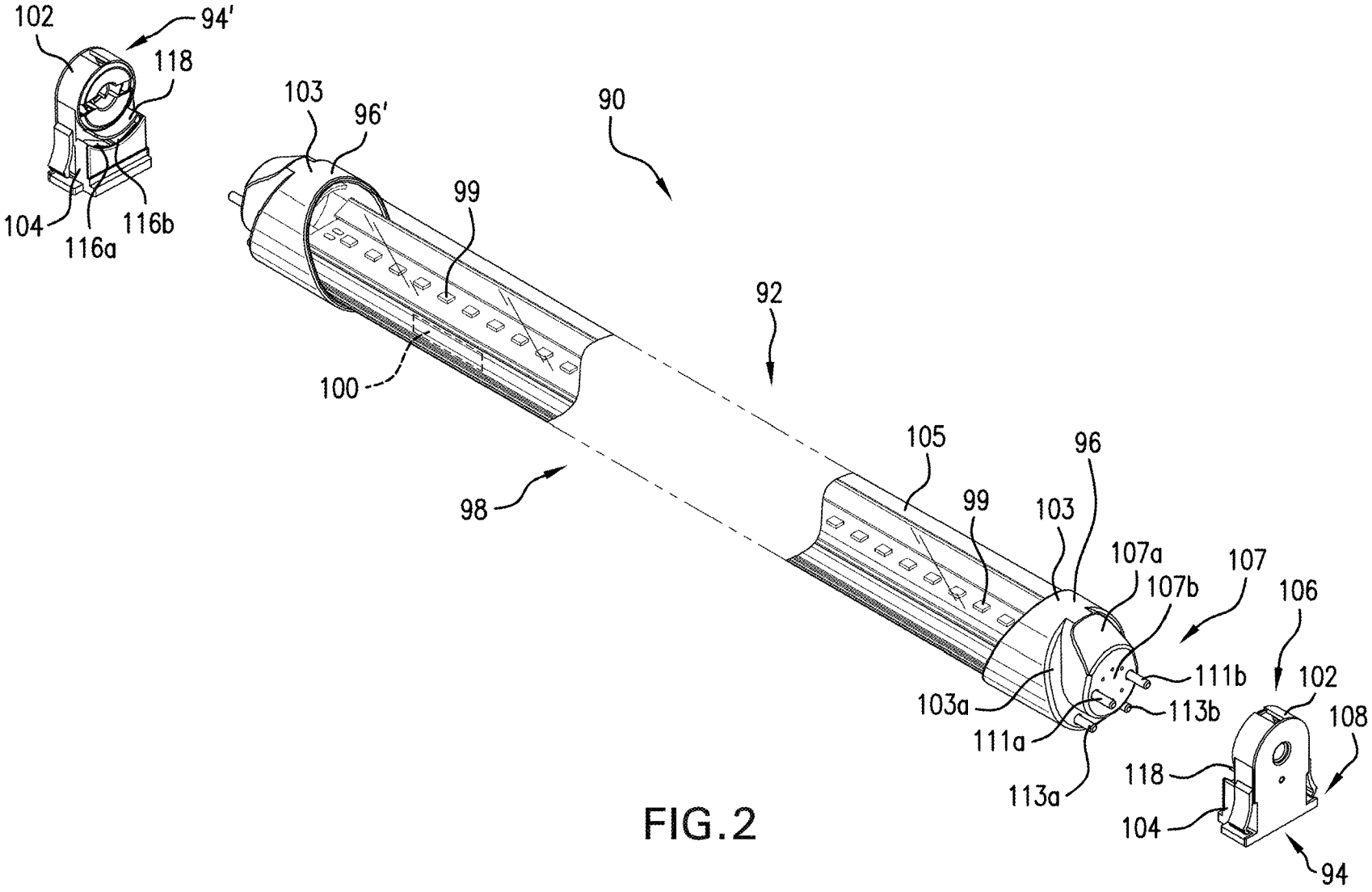
FIG. 2 is an alternative perspective view of the lamp and lamp sockets of FIG. 1, according to one or more embodiments.
Figure 3:
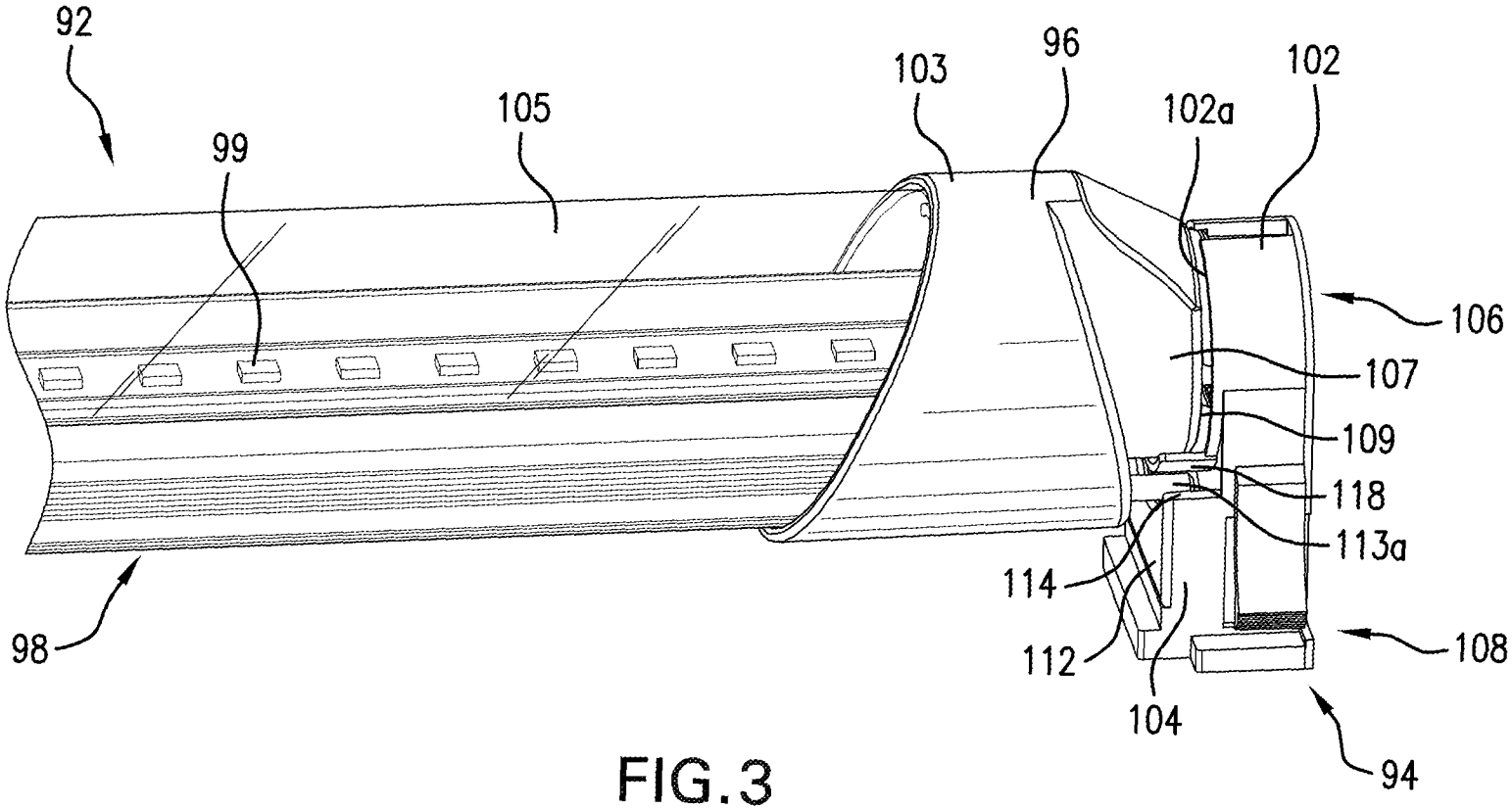
FIG. 3 is an alternative partial perspective view of the lamp and lamp socket in an installed state, according to one or more embodiments.
Figure 4:
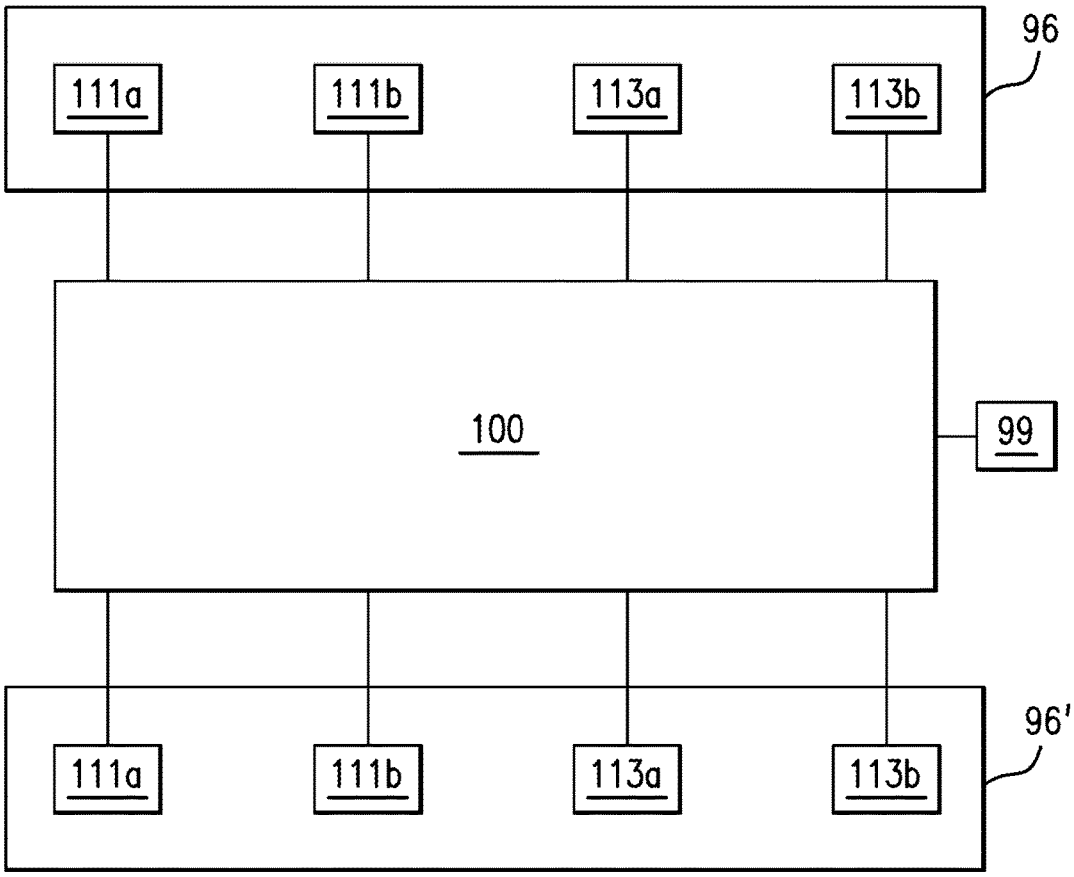
FIG. 4 is a schematic representation of the electrical connection between the various pins of the lamp and the driver of the lamp.

Thus, the auxiliary interface portion 104 can provide for an effective way for control of the TLED lamp 92. It is also noted that the driver 100 is schematically shown in FIGS. 1 and 2. However, it will be appreciated that the driver 100 could take any number of forms without departing from the scope of the disclosure. As schematically shown in FIG. 4, the driver 100 is electrically connected to the primary pins 111*a*, 111*b* and secondary pins 113*a*, 113*b* of the bases 96, 96' and the light emitting diodes 99 to allow the light emitting diodes 99 to illuminate when power is provided through the primary pins 111*a*, 111*b*. Further, the driver 100 can control the lamp 92 based upon digital communication received through the secondary pins 113*a*, 113*b*.

As such, it will be appreciated that the driver 100 is electrically connected to the plurality of light emitting diodes 99, the at least one primary pin 111*a*, and the at least one secondary pin 113*a*. The at least one primary pin 111*a* provides power to the driver 100 to cause the plurality of light emitting diodes 99 to emit light and the at least one secondary pin 113*a* provides a signal to the driver 100 that is distinct from the power provided from the primary pin 111*a*.

The signal contacts 116*a*, 116*b* are configured to interface with the secondary pins 113*a*, 113*b* of the TLED lamp 92 when the primary pins 111*a*, 111*b* of the TLED lamp 92 are received by the power contacts 110*a*, 110*b*. As will be appreciated, the secondary pins 113*a*, 113*b* of the TLED lamp 92 have a size and shape that allow for connection with the signal contacts 116*a*, 116*b*. These signal contacts 116*a*, 116*b* are configured to provide communicate with the TLED lamp 92, which could include communicating control signals to the TLED lamp 92 via the driver 100.

Examples of control signals include dimming control signals (e.g., to control the brightness of the TLED lamp) or operation control signals (e.g., to control logic associated with operation of the TLED lamp). The control signals can be low-voltage control signals, thereby enabling a close spacing of the signal contacts 116*a*, 116*b* (e.g., such that they can be tightly packed). As will be appreciated, these control signals are separate from the power that is supplied to the lamp 92 that causes the driver 100 to illuminate the light emitting diodes 99. Stated plainly, the two primary pins 111*a*, 111*b* are electrically distinct and separate from the two secondary pins 113*a*, 113*b*.

As noted hereinbefore, a TLED fixture can include two lamp sockets 94, 94' disposed at opposite ends for receipt of the TLED lamp 92. In that instance, the first lamp socket 94 could be as previously described and the second lamp socket 94' could include one or more power contacts, but lacking any signal contacts.

With reference to FIG. 1, a separator wall 118 is disposed between the blind bore 109 and the auxiliary interface portion 104. The separator wall 118 may be integral with the housing portion 102 or may be a separate component. As illustrated, the separator wall 118 is disposed between the power contact 110*a*, 110*b* and the signal contact 116*a*, 116*b*. The separator wall 118 may be of the same or different materials than the housing portion 102. Notably, the separator wall 118 may be made of an electrical insulator so as to further electrically isolate the power contact 110*a*, 110*b* and the signal contact 116*a*, 116*b*. As illustrated, the separator wall 118 has a nominal thickness and has a curved shape. The separator wall 118 can extend from the housing face 102*a* in the interior direction so as to share a common vertical plane with the mounting face 112. Notably, the secondary pins 113*a*, 113*b* are spaced from the protrusion 107 so as to permit the insulated separator wall 118 of the lamp socket 94 to be selectively disposed therebetween.

Due to the position of the separator wall 118, some legacy lamps may not be able to be physically installed into the lamp sockets 94, 94' due to contact with the separator wall 118. Thus, only lamps that are compatible with the electrical supply from the power contacts 110*a*, 110*b* can be installed into the lamp sockets 94, 94', thereby ensuring that the installed lamp can operate at peak performance and be appropriately controlled.

As a result, legacy lamps (e.g., FL) would not fit in the lamp sockets 94, 94'. Conversely, the TLED lamp 92 compatible with the lamp sockets 94, 94' shown of FIG. 2 would be backwardly compatible with legacy lamp sockets because the newer TLED lamp 92 would fit in the legacy lamp socket slot with a void in the space which would otherwise be occupied by the auxiliary interface portion 104 of the lamp sockets 94, 94'.

In this way, the separator wall 118 provides a keying feature which prevents incompatible legacy lamp products, including lamps with a traditional G13 type base, from being installed in the lamp sockets 94, 94'. This provides numerous benefits including ensuring that the most compatible lamps are installed in the lamp sockets 94, 94' and also providing enhanced communication and control of the TLED lamp installed therein. Further, the separator wall 118 can protect inadvertent contact with the signal contacts 116*a*, 116*b*.

It will be appreciated that variations of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A tubular light emitting diode lamp, comprising:

a lamp body;

a plurality of light emitting diodes disposed on the lamp body;

a first lamp base and a second lamp base that are disposed at opposite ends of the lamp body, wherein the first lamp base and the second lamp base each include at least one primary pin and at least one secondary pin, wherein the first lamp base and the second lamp base each include a base face from which the respective at least one secondary pin extends, and wherein the first lamp base and the second lamp base also each include a protrusion face that is spaced from the respective base face and is from which the respective at least one primary pin extends; and a driver electrically connected to the plurality of light emitting diodes, the at least one primary pin, and the at least one secondary pin, wherein the least one primary pin provides power to the driver to cause the plurality of light emitting diodes to emit light and the at least one secondary pin provides a signal to the driver that is distinct from the power.

2. The tubular light emitting diode lamp of claim 1, wherein the signal communicated through the at least one secondary pin includes at least one of dimming control signals to control a brightness of the plurality of light emitting diodes and operation control signals to control logic associated with operation of the lamp.

3. The tubular light emitting diode lamp of claim 1, wherein the signal communicated through the at least one secondary pin is a low-voltage control signal that is separate from the power that is supplied through the at least one primary pin to the driver that causes the driver to illuminate the light emitting diodes.

4. The tubular light emitting diode lamp of claim 1, wherein the at least one primary pin includes two primary pins that are electrically distinct and separate from the at least one secondary pin.

5. The tubular light emitting diode lamp of claim 1, wherein the at least one primary pin includes two primary pins and the at least one secondary pin includes two secondary pins, and wherein the two primary pins are electrically distinct and separate from the two secondary pins.

6. The tubular light emitting diode lamp of claim 1, wherein the first lamp base and the second lamp base each include a perimeter wall that at least partially surrounds the lamp body in a circumferential manner, the respective base face being generally orthogonal to the respective perimeter wall, wherein the respective protrusion of the respective first lamp base and the second lamp base extends from the respective base face in a direction away from the lamp body, and wherein each of the respective protrusions includes at least one side wall and the protrusion face, the respective protrusion face being outwardly spaced from the respective base face.

7. The tubular light emitting diode lamp of claim 1, wherein a distance that the at least one secondary pin extends from the base face is less than a distance that the protrusion face is spaced from the base face.

8. The tubular light emitting diode lamp of claim 1, further comprising a lens that is constructed of a material that allows for light from the light emitting diodes to pass therethrough, wherein the lamp body and the lens cooperate to define an interior chamber for receiving the driver that keeps the power from the at least one primary pin and the signal from the at least one secondary pin electrically separate.

9. The tubular light emitting diode lamp of claim 1, wherein a distance between a free end of the primary pin on the first lamp base and a free end of the primary pin on the second lamp base is greater than a distance between a free end of the secondary pin on the first lamp base and a free end of the secondary pin on the second lamp base.

10. The tubular light emitting diode lamp of claim 1, wherein the at least one primary pin includes two primary pins and the at least one secondary pin includes two secondary pins, and wherein the two primary pins are generally parallel to the two secondary pins.

11. The tubular light emitting diode lamp of claim 1, wherein the lamp body extends between the first base and the second base in a tubular manner.

12. The tubular light emitting diode lamp of claim 1, wherein the at least one primary pin includes two primary pins disposed on the first base and two primary pins disposed on the second base and the at least one secondary pin includes two secondary pins disposed on the first base and two secondary pins disposed on the second base, and wherein the two primary pins disposed on the first base are aligned with the two primary pins of the second base such that the respective primary pins of the first base each share a common axis with the respective primary pins of the second base.

13. The tubular light emitting diode lamp of claim 12, wherein the two secondary pins disposed on the first base are aligned with the two secondary pins of the second base such that the respective secondary pins of the first base each share a common axis with the respective secondary pins of the second base.

14. The tubular light emitting diode lamp of claim 1, wherein the at least one secondary pin includes a perimeter surface face and a free end face, and wherein the secondary pin extends from the base face of the first lamp base such that the free end face is generally parallel to the base face, and wherein the perimeter surface is adapted to electrically interface with a respective lamp socket such that less than 50% of a surface area of the perimeter surface face directly contacts a signal contact of the lamp socket.

15. The tubular light emitting diode lamp of claim 1, wherein the base faces of the respective first lamp base and the second lamp base are generally parallel to one another and at least two of the secondary pins extend from each of the base faces, wherein at least two of the primary pins extend from each of the respective base faces, and wherein the secondary pins are spaced from the protrusion so as to permit an insulated separator wall of a lamp socket to be selectively disposed therebetween.

16. A lighting assembly, comprising:

a tubular light emitting diode lamp including a lamp body, a plurality of light emitting diodes disposed on the lamp body, a first lamp base and a second lamp base that are disposed at opposite ends of the lamp body, wherein at least one of the first lamp base and the second lamp base includes at least one primary pin and at least one secondary pin, wherein the first lamp base and the second lamp base each include a protrusion from which the at least one primary pin extends, and a driver electrically connected to the plurality of light emitting diodes, the at least one primary pin, and the at least one secondary pin, wherein the least one primary pin provides power to the driver to cause the plurality of light emitting diodes to emit light and the at least one secondary pin provides a signal to the driver that is distinct from the power; and a first lamp socket and a second lamp socket that are spaced from one another so as to receive the first lamp base and the second lamp base, respectively, wherein at least one of the first lamp socket and the second lamp socket includes at least one power contact configured for electrical connection with the at least one primary pin and at least one signal contact configured for electrical connection with the at least one secondary pin, and wherein the first lamp socket and the second lamp socket each include an insulated separator wall that is received between the protrusion and the at least one secondary pin when the tubular light emitting diode lamp is installed in the first lamp socket and the second lamp socket.

17. The lighting assembly of claim 16, wherein the insulated separator wall provides a keying feature which prevents lamps with a traditional G13 type base from being installed in the first and second lamp sockets.

18. A tubular light emitting diode lamp, comprising:

a lamp body;

a plurality of light emitting diodes disposed on the lamp body;

a first lamp base and a second lamp base that are disposed at opposite ends of the lamp body, wherein at least one of the first lamp base and the second lamp base includes at least one primary pin and at least one secondary pin, wherein at least one of the first lamp base and the second lamp base includes a base face from which the at least one secondary pin extends and the at least one of the first lamp base and the second lamp base also includes a protrusion face that is spaced from the base face and is from which the at least one primary pin extends; and a driver electrically connected to the plurality of light emitting diodes, the at least one primary pin, and the at least one secondary pin, wherein the least one primary pin provides power to the driver to cause the plurality of light emitting diodes to emit light and the at least one secondary pin is configured such that a signal, that is distinct from the power, is communicated therethrough to the driver.

19. The tubular light emitting diode lamp of claim 18, wherein a distance that the at least one secondary pin extends from the base face is less than a distance that the protrusion face is spaced from the base face.

20. The tubular light emitting diode lamp of claim 18, wherein the base faces of the respective first lamp base and the second lamp base are generally parallel to one another and at least two of the secondary pins extend from each of the base faces, wherein at least two of the primary pins extend from each of the respective base faces, and wherein the secondary pins are spaced from the protrusion so as to permit an insulated separator wall of a lamp socket to be selectively disposed therebetween.

* * * * *